US008629892B2

(12) United States Patent
Morooka et al.

(10) Patent No.: US 8,629,892 B2
(45) Date of Patent: Jan. 14, 2014

(54) THERMAL HEAD, METHOD OF MANUFACTURING THERMAL HEAD, AND PRINTER EQUIPPED WITH THERMAL HEAD

(75) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 14 days.

(21) Appl. No.: 13/401,894

(22) Filed: Feb. 22, 2012

(65) Prior Publication Data

US 2012/0212558 A1 Aug. 23, 2012

(30) Foreign Application Priority Data

Feb. 23, 2011 (JP) ..... 2011-037310

(51) Int. Cl.
*B41J 2/335* (2006.01)

(52) U.S. Cl.
USPC ..... 347/202; 347/208

(58) Field of Classification Search
USPC ..... 347/200, 202, 203, 204, 205, 206, 207, 347/208
See application file for complete search history.

(56) References Cited

U.S. PATENT DOCUMENTS 5,252,182 A * 10/1993 Hong ..... 438/21
5,272,489 A * 12/1993 Kobayashi et al. ..... 347/206
5,594,488 A * 1/1997 Tsushima et al. ..... 347/208
6,501,497 B2 * 12/2002 Shirakawa et al. ..... 347/208
7,522,178 B2 * 4/2009 Shoji et al. ..... 347/205
7,768,541 B2 * 8/2010 Koroishi et al. ..... 347/202
7,907,158 B2 * 3/2011 Koyama et al. ..... 347/208
8,098,268 B2 * 1/2012 Kariya et al. ..... 347/206
2002/0024582 A1 * 2/2002 Shirakawa et al. ..... 347/208
2002/0044193 A1 * 4/2002 Sambongi ..... 347/208
2007/0216749 A1 * 9/2007 Koyama et al. ..... 347/208
2012/0050447 A1 * 3/2012 Morooka et al. ..... 347/204

FOREIGN PATENT DOCUMENTS

| | | |
|---|---|---|
| EP | 1842679 | 10/2007 |
| EP | 2179850 | 4/2010 |
| JP | 2009119850 | 6/2009 |

* cited by examiner

*Primary Examiner* — Huan Tran
(74) *Attorney, Agent, or Firm* — Adams & Wilks

(57) ABSTRACT

A thermal printer has a support substrate with a concave portion in a surface thereof, and an upper substrate bonded to the surface of the support substrate and including a convex portion at a position corresponding to the concave portion. A heating resistor is provided on a surface of the upper substrate at a position straddling the convex portion. A pair of electrodes is provided on both sides of the heating resistor, with each of the electrodes being formed in a region outside of the convex portion. The convex portion extends at a height greater than each of the electrodes. At least one of the pair of electrodes has a thin portion connected to the heating resistor in a region corresponding to the concave portion, and a thick portion connected to the heating resistor and having a thickness greater than that of the thin portion.

17 Claims, 11 Drawing Sheets

THERMAL HEAD, METHOD OF MANUFACTURING THERMAL HEAD, AND PRINTER EQUIPPED WITH THERMAL HEAD

BACKGROUND OF THE INVENTION

1. Field of the Invention

The present invention relates to a thermal head, a method of manufacturing the thermal head, and a printer equipped with the thermal head.

2. Description of the Related Art

There has been conventionally known a thermal head for use in thermal printers, which performs printing on a thermal recording medium such as paper by selectively driving a plurality of heating elements based on printing data (see, for example, Japanese Patent Application Laid-open No. 2009-119850).

In the thermal head disclosed in Japanese Patent Application Laid-open No. 2009-119850, an upper substrate is bonded to a support substrate having a concave portion formed therein and heating resistors are provided on the upper substrate so that a cavity portion is formed in a region between the upper substrate and the support substrate so as to correspond to the heating resistors. This thermal head allows the cavity portion to function as a heat-insulating layer having low thermal conductivity so as to reduce an amount of heat transferring from the heating resistors to the support substrate, to thereby increase thermal efficiency to reduce power consumption.

A printer having the above-mentioned thermal head installed therein has a pressure mechanism for pressing thermal paper against a platen roller in a sandwiched manner. In order that heat of the surface of the thermal head be effectively transferred to the thermal paper, the thermal head is pressed against the thermal paper with an appropriate pressing force. Accordingly, the thermal head is required to have strength high enough to withstand the pressing force applied by the pressure mechanism.

Further, when the thermal paper is pressed against the surface of the thermal head by the platen roller, an air layer is formed between the thermal paper and the surface of the thermal head because of steps defined between the heating resistors and electrodes provided on both sides of the heating resistors. The heat generated by the heating resistors is hindered by the air layer from transferring to the thermal paper, which is inconvenient because thermal efficiency of the thermal head may decrease.

Further, the heat generated by the heating resistors diffuses also in the planar direction of the upper substrate via the electrodes. In particular, when the electrodes are thickened, the electrical resistance value of the electrodes can be reduced, but the amount of heat that diffuses via the electrodes is increased. Therefore, the conventional thermal head has a problem that high heat insulating performance exerted by the cavity portion cannot be fully utilized because the heat dissipates from the heating resistors in the planar direction of the upper substrate via the electrodes.

SUMMARY OF THE INVENTION

The present invention has been made in view of the above-mentioned circumstances, and it is an object thereof to provide a thermal head capable of improving thermal efficiency while ensuring strength high enough to withstand a pressing force applied by a pressure mechanism, and also provide a method of manufacturing the thermal head, and a printer equipped with the thermal head.

In order to achieve the above-mentioned object, the present invention provides the following techniques.

According to a first aspect of the present invention, there is provided a thermal head, including: a support substrate including a concave portion formed in a front surface thereof; an upper substrate, which is bonded in a stacked state to the front surface of the support substrate and includes a convex portion formed at a position corresponding to the concave portion; a heating resistor provided on a front surface of the upper substrate at a position straddling the convex portion; and a pair of electrodes provided on both sides of the heating resistor, in which at least one of the pair of electrodes includes: a thin portion, which is connected to the heating resistor in a region corresponding to the concave portion; and a thick portion, which is connected to the heating resistor and is formed thicker than the thin portion.

According to the first aspect of the present invention, the upper substrate provided with the heating resistor functions as a heat storage layer that stores heat generated from the heating resistor. Further, the support substrate including the concave portion formed in its front surface and the upper substrate are bonded to each other in the stacked state, to thereby form a cavity portion between the support substrate and the upper substrate. The cavity portion is formed in a region corresponding to the heating resistor and functions as a heat-insulating layer that blocks the heat generated from the heating resistor. Therefore, according to the first aspect of the present invention, the heat generated from the heating resistor may be prevented from transferring and dissipating to the support substrate via the upper substrate. As a result, use efficiency of the heat generated from the heating resistor, that is, thermal efficiency of the thermal head may be increased.

Further, in the front surface of the upper substrate on the electrode side, the convex portion is formed between the pair of electrodes provided on both sides of the heating resistor so that smaller steps may be defined between the heating resistor formed on a surface of the convex portion and the electrodes provided at both ends of the heating resistor. Accordingly, an air layer to be formed between a front surface of the heating resistor and thermal paper may be reduced in size. Therefore, according to the first aspect of the present invention, the heat generated by the heating resistor may transfer to the thermal paper efficiently, to thereby increase the thermal efficiency of the thermal head to reduce an amount of energy required for printing.

In this case, the heat generated by the heating resistor diffuses also in the planar direction of the upper substrate via the electrodes. In the thermal head according to the present invention, the thin portion of at least one of the electrodes, which is disposed above the cavity portion, has thermal conductivity lower than other regions (thick portion) of the electrode. Therefore, by providing the thin portion in the region corresponding to the cavity portion (concave portion), the heat generated from the heating resistor may be prevented from easily transferring to the outside of the region corresponding to the cavity portion. This suppresses the diffusion of the heat, which is prevented by the cavity portion from transferring toward the support substrate, in the planar direction of the upper substrate via the electrode. Therefore, the heat may be transferred to an opposite side of the support substrate to increase printing efficiency.

When a load is applied to the upper substrate during printing, the upper substrate is deformed in a region corresponding to the concave portion, and accordingly a tensile stress occurs at a rear surface of the upper substrate in the above-mentioned region. On this occasion, the convex portion formed in the upper substrate in the region corresponding to the concave portion contributes to enhanced strength of the upper substrate, unlike an upper substrate having a uniform thickness.

In the above-mentioned thermal head, the pair of electrodes may each be formed in a region outside the convex portion.

The electrode including the thin portion is disposed on the outer side of the convex portion, and hence the thin portion may be prevented from being applied with pressure from a platen roller, and the reliability of the thermal head may be improved.

In the above-mentioned thermal head, the convex portion may be formed within a region corresponding to the concave portion.

With such a structure, in the region of the front surface of the upper substrate corresponding to the cavity portion (concave portion), a region in which the convex portion is not formed, that is, a region in which the thickness of the upper substrate is thin, may be provided. This reduces the diffusion of the heat in the planar direction of the upper substrate. Therefore, the thermal efficiency of the thermal head may be improved.

In the above-mentioned thermal head, the convex portion may include: a flat distal end surface; and side surfaces formed extending and inclining from both ends of the distal end surface so that the convex portion is gradually narrower toward the distal end surface.

Because the convex portion has the flat distal end surface, a load of a platen roller may be imposed over the distal end surface of the convex portion, to thereby prevent a concentrated load from being imposed on a part of the convex portion. Further, because the side surfaces are formed extending and inclining from the both ends of the distal end surface so that the convex portion may be gradually narrower toward the distal end surface, it is easy to form the heating resistor on the side surfaces of the convex portion.

In the above-mentioned thermal head, the thin portion may extend to an outside of the region corresponding to the concave portion.

With such a structure, the region of low thermal conductivity (thin portion) of the electrode extends to the outside of the region corresponding to the cavity portion. Accordingly, the diffusion of heat from the heating resistor in the planar direction of the upper substrate via the electrodes may be suppressed more. Therefore, the thermal efficiency of the thermal head may be improved.

In the above-mentioned thermal head, both of the pair of electrodes may include the thin portion.

With such a structure, in any of the electrodes, the heat generated from the heating resistor may be prevented from easily transferring to the outside of the region corresponding to the cavity portion. Therefore, the diffusion of heat in the planar direction of the upper substrate via the electrodes may be suppressed more effectively.

According to a second aspect of the present invention, there is provided a printer, including: the above-mentioned thermal head; and a pressure mechanism for feeding a thermal recording medium while pressing the thermal recording medium against a heating resistor of the thermal head.

The printer described above includes the above-mentioned thermal head, and hence, while ensuring the strength of the upper substrate, the thermal efficiency of the thermal head may be increased to reduce the amount of energy required for printing. Therefore, printing on the thermal recording medium may be performed with low power to prolong battery duration. Besides, a failure due to the breakage of the upper substrate may be prevented to enhance the device reliability.

According to a third aspect of the present invention, there is provided a method of manufacturing a thermal head, including: forming an opening portion in a front surface of a support substrate; bonding a rear surface of an upper substrate in a stacked state to the front surface of the support substrate, which has the opening portion formed therein in the forming an opening portion; thinning the upper substrate, which is bonded to the support substrate in the bonding; forming a convex portion in a front surface of the upper substrate, which is bonded to the support substrate in the bonding; forming a heating resistor on the front surface of the upper substrate in a region corresponding to the opening portion; and forming electrode layers at both ends of the heating resistor, which is formed in the forming a heating resistor, the electrode layers each including a thin portion, which is connected to the heating resistor in a region corresponding to the opening portion, and a thick portion, which is connected to the heating resistor and is formed thicker than the thin portion.

According to the method of manufacturing a thermal head described above, a thermal head may be manufactured in which the cavity portion is formed between the support substrate and the upper substrate, and the convex portion is formed between the electrode layers formed at both ends of the heating resistor. Further, at both the ends of the heating resistor, the electrode layers each including the thin portion which is connected to the heating resistor in the region corresponding to the concave portion and the thick portion which is connected to the heating resistor and is formed thicker than the thin portion may be formed. Accordingly, as described above, while ensuring the strength of the upper substrate, the thermal efficiency of the thermal head may be increased to reduce the amount of energy required for printing.

The present invention provides the effect that the thermal efficiency can be improved while ensuring the strength high enough to withstand a pressing force applied by a pressure mechanism.

BRIEF DESCRIPTION OF THE DRAWINGS

In the accompanying drawings:

FIGS. 4A to 4C are views illustrating how a concentrated load is applied to the thermal head of FIG. 3, in which FIG. 4A is a cross-sectional view before the load application, FIG. 4B is a cross-sectional view under the load application, and FIG. 4C is a plan view under the load application;

FIGS. 8A to 8H are views illustrating a method of manufacturing a thermal head according to a second embodiment of the present invention, in which FIG. 8A illustrates an opening portion forming step; FIG. 8B, a bonding step; FIG. 8C, a thinning step; FIG. 8D, a convex portion forming step; FIG. 8E, a resistor forming step; FIG. 8F, an electrode layer forming step (first layer forming step); FIG. 8G, an electrode layer forming step (second layer forming step); and FIG. 8H, a protective film forming step;

FIGS. 9A to 9H are views illustrating a method of manufacturing a thermal head according to a modified example of FIGS. 8A to 8H, in which FIG. 9A illustrates an opening portion forming step; FIG. 9B, a bonding step; FIG. 9C, a thinning step; FIG. 9D, a convex portion forming step; FIG. 9E, a resistor forming step; FIG. 9F, an electrode layer forming step (thick electrode layer forming step); FIG. 9G an electrode layer forming step (electrode layer removing step); and FIG. 9H, a protective film forming step;

FIGS. 11A to 11C are views illustrating how a concentrated load is applied to the thermal head of FIG. 10, in which FIG. 11A is a cross-sectional view before the load application, FIG. 11B is a cross-sectional view under the load application, and FIG. 11C is a plan view under the load application.

DETAILED DESCRIPTION OF THE PREFERRED EMBODIMENTS

First Embodiment

A thermal head 1 and a thermal printer 10 according to a first embodiment of the present invention are described below with reference to the accompanying drawings.

Figure 1:
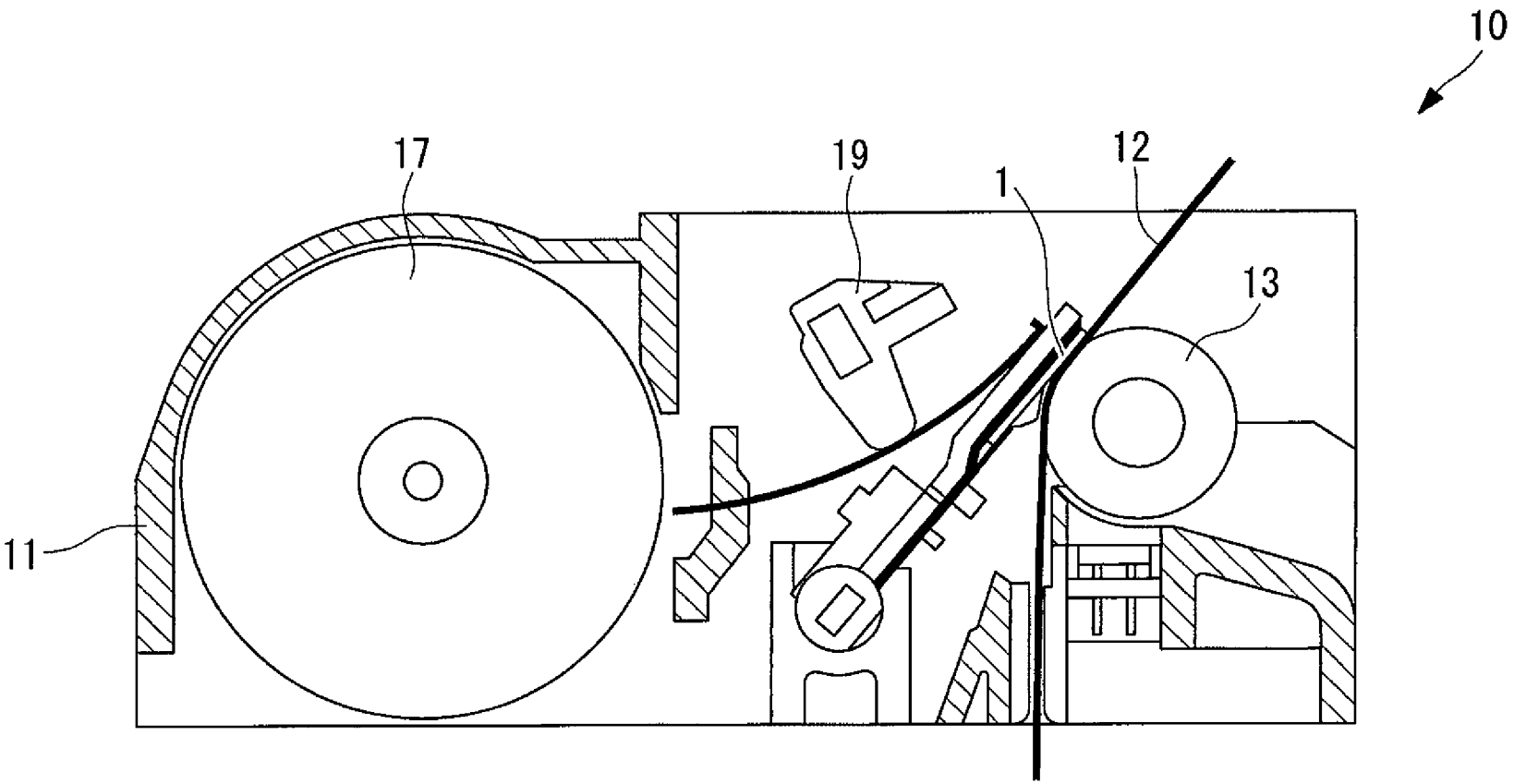
FIG. 1 is a schematic structural view of a thermal printer according to a first embodiment of the present invention.

The thermal head 1 according to this embodiment is used for, for example, in the thermal printer 10 as illustrated in FIG. 1, and performs printing on an object to be printed, such as thermal paper 12, by selectively driving a plurality of heating elements based on printing data.

The thermal printer 10 includes a main body frame 11, a platen roller 13 disposed with its central axis being horizontal, the thermal head 1 disposed opposite to an outer peripheral surface of the platen roller 13, a heat dissipation plate (not shown) supporting the thermal head 1, a paper feeding mechanism 17 for feeding the thermal paper 12 between the platen roller 13 and the thermal head 1, and a pressure mechanism 19 for pressing the thermal head 1 against the thermal paper 12 with a predetermined pressing force.

Against the platen roller 13, the thermal paper 12 is pressed via the thermal head 1 by the operation of the pressure mechanism 19. Accordingly, a reaction force of the platen roller 13 is applied to the thermal head 1 via the thermal paper 12.

The heat dissipation plate is a plate-shaped member made of a metal such as aluminum, a resin, ceramics, glass, or the like, and serves for fixation and heat dissipation of the thermal head 1.

Figure 2:
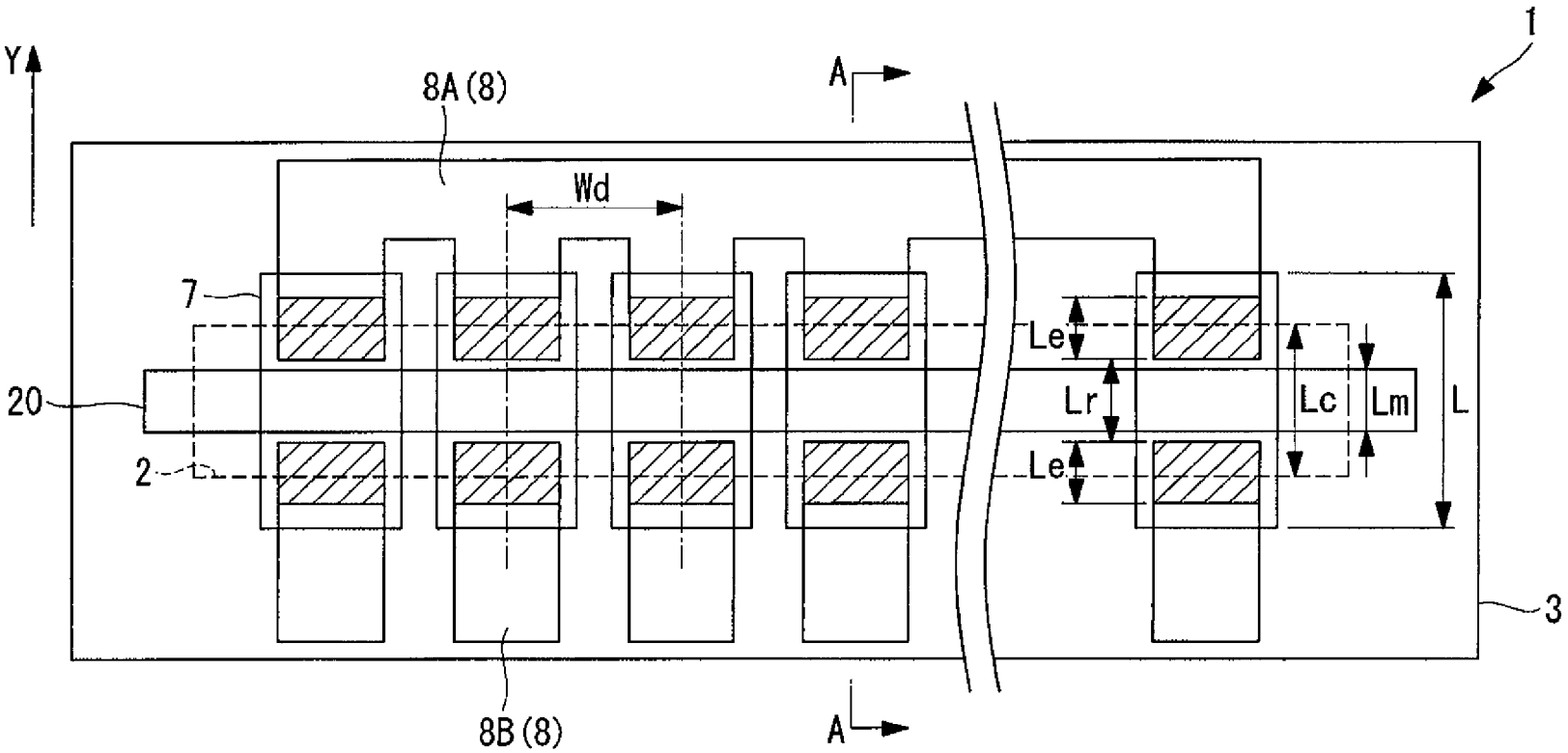
FIG. 2 is a plan view of a thermal head of FIG. 1 viewed from a protective film side.

As illustrated in FIG. 2, in the thermal head 1, a plurality of heating resistors 7 and a plurality of electrodes 8 are arrayed in a longitudinal direction of a rectangular support substrate 3. The arrow Y represents a feeding direction of the thermal paper 12 by the paper feeding mechanism 17. Further, in a front surface of the support substrate 3, a rectangular concave portion 2 is formed extending in the longitudinal direction of the support substrate 3. Herein, symbols Lr, Lm, Lc, and Le represent a width dimension of each heating portion 7A, a width dimension of a convex portion 20, a width dimension of a distal end surface 21 of the convex portion 20, a width dimension of the concave portion 2, and a longitudinal dimension of a thin portion 18, respectively, which are described later.

Figure 3:
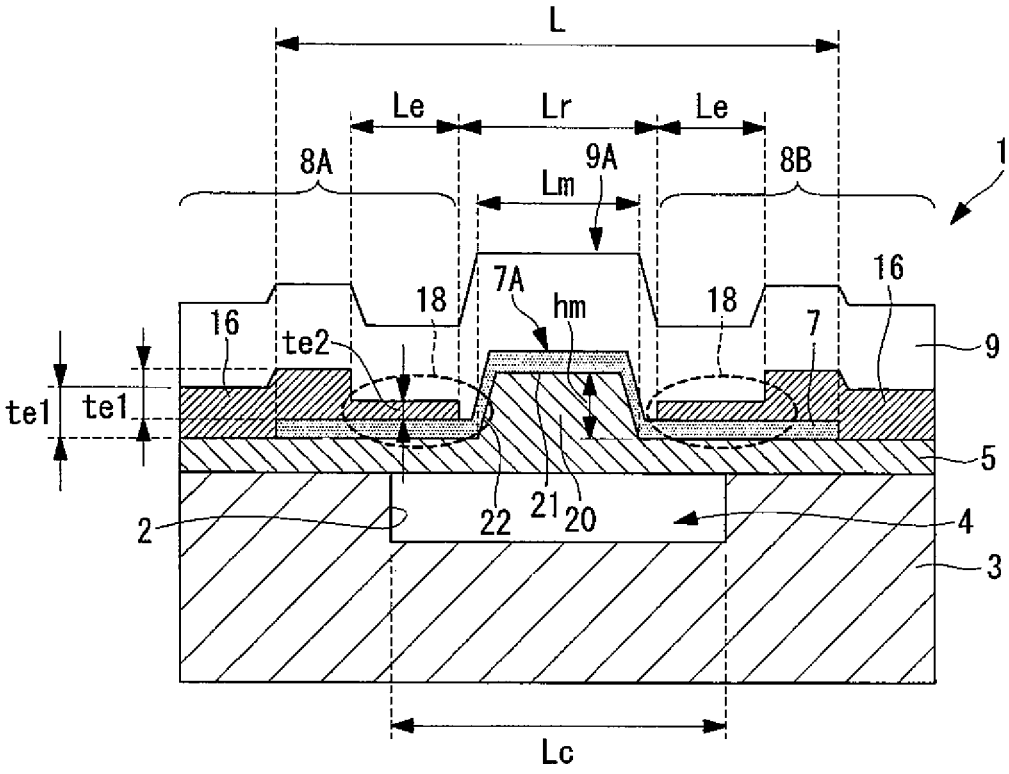
FIG. 3 is a cross-sectional view taken along the arrow A-A of the thermal head of FIG. 2.

FIG. 3 illustrates a cross-section taken along the arrow A-A of FIG. 2.

As illustrated in FIG. 3, the thermal head 1 includes the support substrate 3, an upper substrate 5 bonded to an upper end surface (front surface) of the support substrate 3, the heating resistors 7 provided on the upper substrate 5, the pairs of electrodes 8 provided on both sides of the heating resistors 7, and a protective film 9 for covering the heating resistors 7 and the electrodes 8 to protect the heating resistors 7 and the electrodes 8 from abrasion and corrosion.

The support substrate 3 is, for example, an insulating substrate such as a glass substrate or a silicon substrate having a thickness approximately ranging from 300 μm to 1 mm. In the upper end surface (front surface) of the support substrate 3, that is, at an interface between the support substrate 3 and the upper substrate 5, the rectangular concave portion 2 extending in the longitudinal direction of the support substrate 3 is formed. The concave portion 2 is, for example, a groove with a depth approximately ranging from 1 μm to 100 μm and a width approximately ranging from 50 μm to 300 μm.

The upper substrate 5 is formed of, for example, a glass material with a thickness approximately ranging from 10 μm to 100 μm±5 μm, and functions as a heat storage layer for storing heat generated from the heating resistors 7. The upper substrate 5 is bonded in a stacked state to the front surface of the support substrate 3 so as to hermetically seal the concave portion 2. The concave portion 2 is covered with the upper substrate 5, to thereby form a cavity portion 4 between the upper substrate 5 and the support substrate 3.

The cavity portion 4 has a communication structure opposed to all the heating resistors 7. The cavity portion 4 functions as a hollow heat-insulating layer for preventing the heat, which is generated from the heating resistors 7, from transferring from the upper substrate 5 to the support substrate 3. Because the cavity portion 4 functions as the hollow heat-insulating layer, an amount of heat, which transfers to the above of the heating resistors 7 and is used for printing and the like, may be increased to be more than an amount of heat, which transfers to the support substrate 3 via the upper substrate 5 located under the heating resistors 7. As a result, thermal efficiency of the thermal head 1 may be increased.

The heating resistors 7 are each provided on the upper end surface of the upper substrate 5 so as to straddle the concave portion 2 in its width direction, and as illustrated in FIG. 2, a plurality of the heating resistors 7 are arrayed at predetermined intervals in a longitudinal direction of the concave portion 2. In other words, each of the heating resistors 7 is provided opposite to the cavity portion 4 through the intermediation of the upper substrate 5 so as to be situated above the cavity portion 4.

The pair of electrodes 8 supply the heating resistors 7 with current to allow the heating resistors 7 to generate heat. The electrodes 8 include a common electrode 8A connected to one end of each of the heating resistors 7 in a direction orthogonal to the array direction of the heating resistors 7, and individual electrodes 8B connected to another end of each of the heating resistors 7. As illustrated in FIG. 2, the common electrode 8A is integrally connected to all the heating resistors 7, and the respective individual electrodes 8B are connected to each of the heating resistors 7.

When voltage is selectively applied to the individual electrodes 8B, current flows through the heating resistors 7 which are connected to the selected individual electrodes 8B and the common electrode 8A opposed thereto, to thereby allow the heating resistors 7 to generate heat. In this state, the pressure mechanism 19 operates to press the thermal paper 12 against a surface portion (printing portion) of the protective film 9 covering the heating portions of the heating resistors 7, and then color is developed on the thermal paper 12 to be printed.

Note that, of each of the heating resistors 7, an actually heating portion (heating portion 7A illustrated in FIG. 3) is a portion of each of the heating resistors 7 that the electrode 8A or 8B does not overlap, that is, a region of each of the heating resistors 7 between the connecting surface of the common electrode 8A and the connecting surface of each of the individual electrodes 8B, which is situated substantially directly above the cavity portion 4.

Further, it is desired that, as illustrated in FIG. 2, the pair of electrodes 8A and 8B be disposed so that the length (heater length) Lr of the heating portion 7A extending in the longitudinal direction of the heating resistor 7 may be smaller than a distance (inter-dot distance or dot pitch) Wd between the center positions of adjacent heating resistors 7.

Further, as illustrated in FIG. 3, each of the electrodes 8A and 8B includes the thin portion 18 at a connection portion disposed on the surface of the heating resistor 7. The thin portion 18 is thinner than other regions (thick portion 16 to be described later). In other words, each of the electrodes 8A and 8B is formed so as to be thick at the portion disposed on the upper substrate 5 and a part of the connection portion disposed on the heating resistor 7 and so as to be thin at the remaining part of the connection portion disposed on the heating resistor 7.

The thick portion 16 has a thickness te1 of 1 μm to 3 μm, for example. It is desired to set the thickness te1 of the thick portion 16 to fall in such a range as to secure a sufficient electrical resistance value so that the electrical resistance value of the thick portion 16 may be, for example, approximately 1/10 of the electrical resistance value of the heating resistor 7 or lower.

The thin portion 18 is formed in a range of from the inside of the region on the heating resistor 7 corresponding to the concave portion 2 to the outside of the region. A thickness te2 of the thin portion 18 is, for example, approximately 50 nm to approximately 300 nm and is designed in consideration of the thickness te1 and the thermal conductivity of the thick portion 16 (the thermal conductivity of Al is approximately 200 W/(m·° C.)) and the thickness and the thermal conductivity of the upper substrate 5 (the thermal conductivity of commonly-used glass is approximately 1 W/(m·° C.)).

When the thickness te2 of the thin portion 18 is set smaller than the thickness te1 of the thick portion 16, the thermal conductivity of the electrodes 8A and 8B is reduced in part and heat insulating efficiency is increased. However, when the thickness te2 of the thin portion 18 is set too small (for example, when the thickness te2 of the thin portion 18 is set smaller than 10 nm), the electrical resistance values of the electrodes 8A and 8B are increased in part, with the result that a power loss at the thin portion 18 exceeds the amount of power obtained by increasing the heat insulating efficiency. In addition, the thickness te2 of the thin portion 18 needs to be set considering such a thickness as to be obtained by sputtering as a thin film. Therefore, it is desired to set the thickness te2 of the thin portion 18 to, for example, approximately 50 nm to approximately 300 nm.

Further, when the length Le of each of the thin portions 18 extending in the longitudinal direction of the heating resistors 7 is set larger, the thermal conductivity of the electrodes 8A and 8B is reduced in part and the heat insulating efficiency is increased. However, when the length Le of the thin portion 18 is set too large, the electrical resistance values of the electrodes 8A and 8B are increased in part, with the result that a power loss at the thin portion 18 exceeds the amount of power obtained by increasing the heat insulating efficiency. Therefore, it is desired to determine the length Le of the thin portion 18 so that the electrical resistance value of each of the thin portions 18 may be 1/10 of the electrical resistance value of the heating portion 7A or lower.

Further, it is desired that the thin portion 18 be disposed within the width (nip width) in a range in which the platen roller 13 and a head portion 9A are brought into contact with each other through the thermal paper 12. Although the nip width is varied depending on the diameter and material of the platen roller 13, it is considered that the nip width generally corresponds to a length L of the heating resistor 7 in the longitudinal direction as illustrated in FIG. 3. For example, a width dimension (Lr+2Le) from the thin portion 18 of the electrode 8A to the thin portion 18 of the electrode 8B is set within approximately 2 mm (within approximately 1 mm from the center position of the heating portion 7A). Further, the thick portion 16 provided on the heating resistor 7 is also disposed within the nip width.

Each of the electrodes 8A and 8B having the above-mentioned shapes has a two-stage structure in which a part of the thick portion 16 and the entire thin portion 18 are disposed on the heating resistor 7. In each of the electrodes 8A and 8B, the region disposed at a step portion between the heating resistor 7 and the upper substrate 5 is formed thick (as the thick portion 16). In this manner, disconnection of the electrodes 8A and 8B and an abnormal increase in electrical resistance value caused by the step may be prevented to increase the heat insulating efficiency and increase the reliability of the thermal head 10.

As illustrated in FIG. 3, the upper substrate 5 has the convex portion 20 formed in the upper surface (front surface) on which the heating resistors 7 are provided, in a region between the common electrode 8A and the individual electrodes 8B. The convex portion 20 has a flat distal end surface 21, and side surfaces 22 formed extending and inclining from both ends of the distal end surface 21 so that the convex portion 20 becomes gradually narrower toward the distal end surface 21. In other words, the convex portion 20 is formed so that the width dimension of the distal end surface 21 is smaller than the width dimension Lm of the convex portion 20. This way, the convex portion 20 has a trapezoidal shape in longitudinal cross-section.

Further, the convex portion 20 is formed so that the width dimension Lm thereof is smaller than the width dimension Lc of the concave portion 2. In other words, the convex portion 20 is formed on the upper end side (front surface) of the upper substrate 5 within a region corresponding to the concave portion 2 formed in the support substrate 3. Note that, the convex portion 20 is formed to have a height hm approximately ranging from, for example, 0.5 μm to 3 μm, which is larger than a thickness of the electrodes 8.

Now, as a comparative example, a structure of a conventional thermal head 100 is described below.

Figure 10:
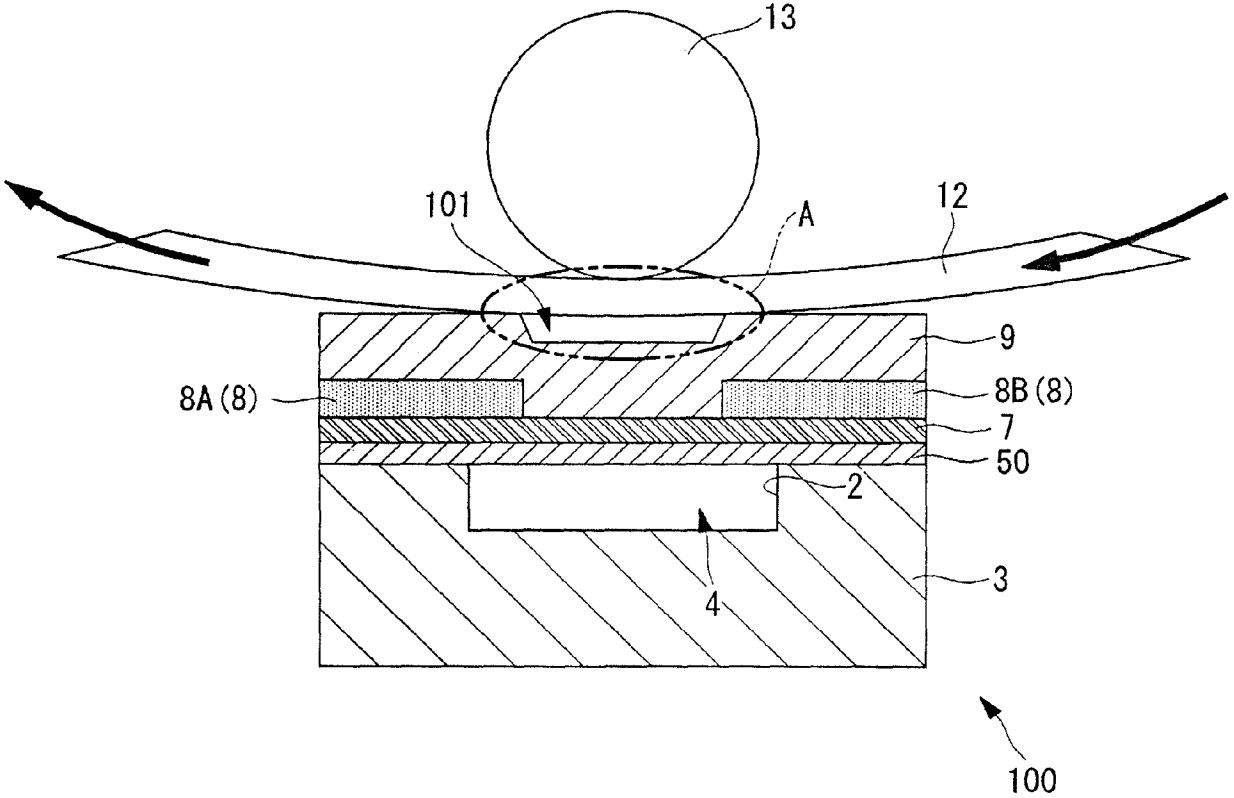
PRIOR ART FIG.10
FIG. 10 is a cross-sectional view of a conventional thermal head.

As illustrated in FIG. 10, in the conventional thermal head 100, no convex portion is provided on an upper end side (front surface) of an upper substrate 50, and hence steps are defined between the heating resistors 7 and the electrodes 8 correspondingly to the thickness of the electrodes 8. Accordingly, also in the front surface of the protective film 9 formed over the heating resistors 7 and the electrodes 8, steps are defined at positions corresponding to the above-mentioned steps (in a region A illustrated in FIG. 10).

As a result, when the thermal paper 12 is pressed against a surface of the thermal head 100 by the platen roller 13, an air layer 101 is formed between the thermal paper 12 and the surface of the thermal head 100 because of the steps between the heating resistors 7 and the electrodes 8. The heat generated by the heating resistors 7 is hindered by the air layer 101 from transferring to the thermal paper 12, which is disadvantageous because thermal efficiency of the thermal head 100 may be decreased.

In contrast, as illustrated in FIG. 3, according to the thermal head 1 according to this embodiment, the support substrate 3 including the concave portion 2 formed in its front surface and the upper substrate 5 are bonded to each other in the stacked state, to thereby form the cavity portion 4 between the support substrate 3 and the upper substrate 5. The cavity portion 4 is formed in the region corresponding to the heating resistors 7 and functions as a heat-insulating layer that blocks the heat generated from the heating resistors 7. Therefore, according to the thermal head 1 of this embodiment, the heat generated from the heating resistors 7 may be prevented from transferring and dissipating to the support substrate 3 via the upper substrate 5. As a result, use efficiency of the heat generated from the heating resistors 7, that is, thermal efficiency of the thermal head 1 may be increased.

Further, on the surface of the upper substrate 5 on the electrode 8 side, the convex portion 20 is formed between the pair of electrodes 8 provided on both sides of the heating resistor 7. Accordingly, the steps between the heating resistor 7 formed on the surface of the convex portion 20 and the electrodes 8 provided on both sides of the heating resistor 7 may be reduced, to thereby reduce an air layer to be formed between the surface of the heating resistor 7 (protective film 9) and the thermal paper. Therefore, according to the thermal head 1 of this embodiment, the heat generated by the heating resistors 7 may transfer to the thermal paper 12 efficiently, to thereby increase the thermal efficiency of the thermal head 1 to reduce the amount of energy required for printing.

In particular, the height of the convex portion 20 is larger than the height of the electrodes 8, and hence an air layer to be formed between the surface of the thermal head 1 and the thermal paper 12 may be eliminated so that the surface of the thermal head 1 and the thermal paper 12 may be brought into intimate contact with each other. Accordingly, the heat generated by the heating resistors 7 may transfer to the thermal paper 12 efficiently, to thereby increase the thermal efficiency of the thermal head 1 to reduce the amount of energy required for printing.

In this case, the heat generated by the heating resistors 7 diffuses also in the planar direction of the upper substrate 5 via the electrodes 8. In the thermal head 1 according to this embodiment, the thin portion 18 of the electrode 8, which is disposed above the cavity portion 4, has thermal conductivity lower than other regions (thick portion 16) of the electrode 8. Therefore, by providing the thin portion 18 in the region corresponding to the cavity portion 4 (concave portion 2), the heat generated from the heating resistors 7 may be prevented from easily transferring to the outside of the region corresponding to the cavity portion 4. This suppresses the diffusion of the heat, which is prevented by the cavity portion 4 from transferring toward the support substrate 3, in the planar direction of the upper substrate 5 via the electrode 8. Therefore, the heat may be transferred to an opposite side of the support substrate 3 to increase printing efficiency.

Next, description is given below of how the thermal head 1 according to this embodiment is different in strength from the conventional thermal head 100.

Figure 4A:
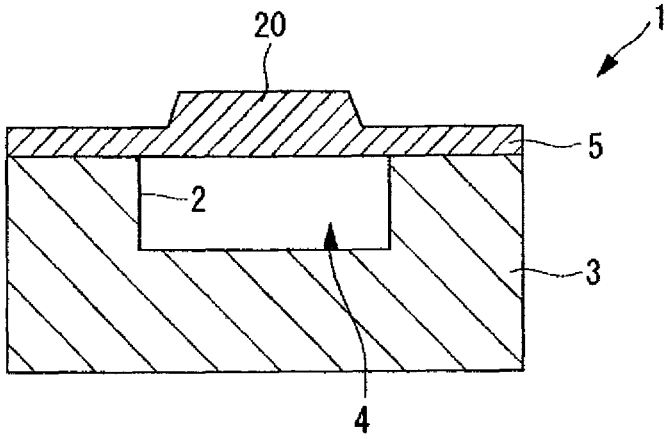
Figure 4B:
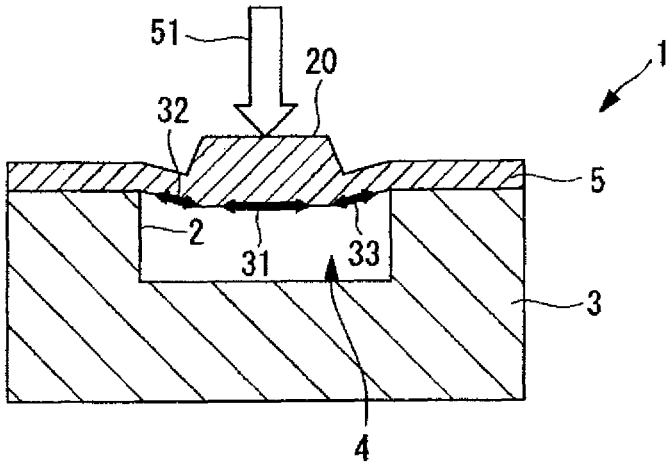
Figure 4C:
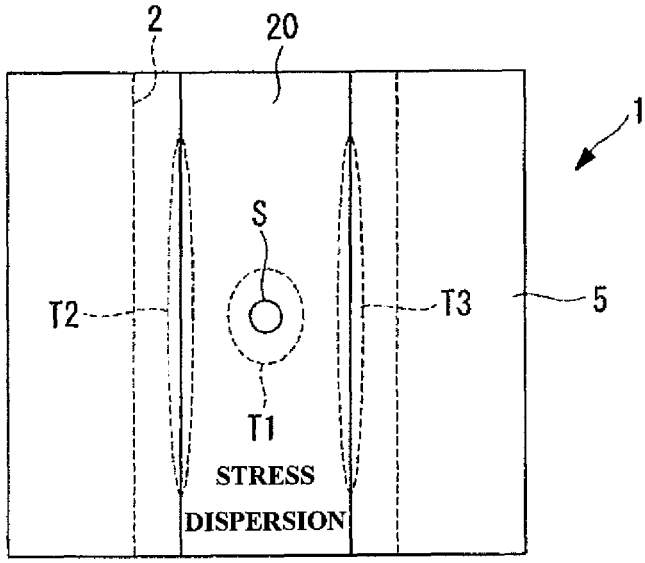
Figure 11A:
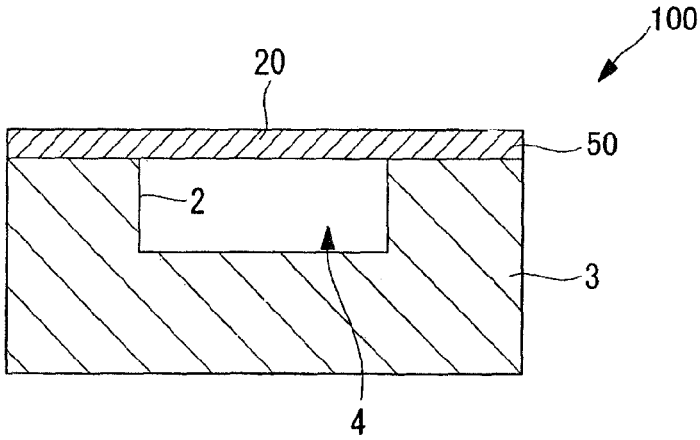
PRIOR ART FIG.11A
Figure 11B:
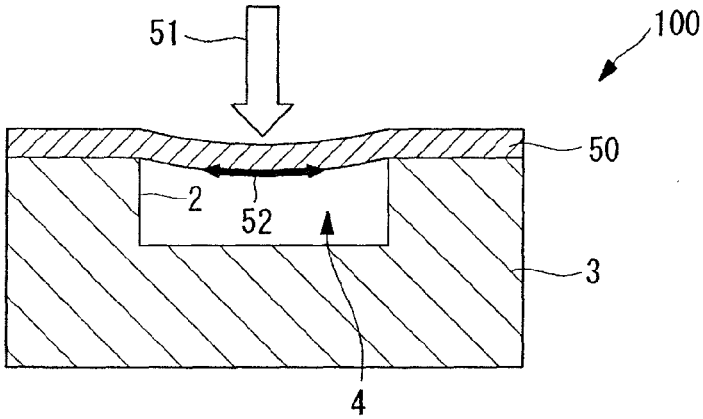
PRIOR ART FIG.11B
Figure 11C:
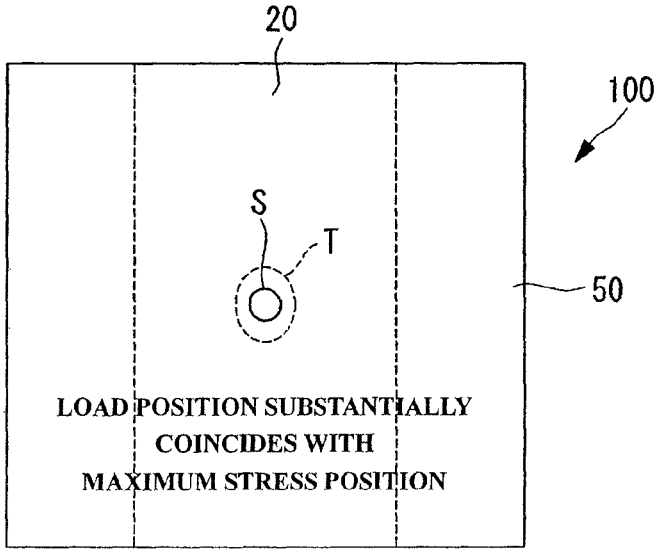
PRIOR ART FIG.11C

Aimed at describing the difference in strength, FIGS. 4A to 4C and FIGS. 11A to 11C are simplified to illustrate only the upper substrate and the support substrate of the thermal head. FIGS. 4A to 4C illustrate the thermal head 1 according to this embodiment, and FIGS. 11A to 11C illustrate the conventional thermal head 100.

As illustrated in FIG. 11A, in the conventional thermal head 100, the upper end side (front surface) of the upper substrate 50 has a flat shape. In the conventional thermal head 100, as illustrated in FIG. 11B, when a concentrated load (arrow 51) is applied onto the upper substrate 50 above the cavity portion 4, the portion of the upper substrate 50 opposed to the cavity portion 4 is deformed and sinks downward. Accordingly, as indicated by an arrow 52 of FIG. 11B, a large tensile stress occurs at a lower end surface (rear surface) of the upper substrate 50, especially at a central position of the applied load. In this case, as illustrated in FIG. 11C, a load position S substantially coincides with a maximum stress position T, with the result that the upper substrate 50 is likely to be broken.

In contrast, as illustrated in FIG. 4A, the thermal head 1 according to this embodiment has the convex portion 20 formed on the upper end side (in the front surface) of the upper substrate 5. Because of such a structure, as illustrated in FIG. 4B, when the concentrated load (arrow 51) is applied to the upper substrate 5 above the cavity portion 4, large tensile stresses (arrows 31, 32, and 33) occur at the lower end surface (rear surface) of the upper substrate 5 at a central position of the applied load and the base portions of the convex portion 20, respectively. Therefore, as illustrated in FIG. 4C, the positions applied with the large stresses are dispersed into regions T1, T2, and T3, respectively.

As described above, unlike the upper substrate 50 with a uniform thickness as illustrated in FIG. 11A, the upper substrate 5 of the thermal head 1 according to this embodiment is thick (as the convex portion 20) at the position corresponding to the cavity portion 4 (concave portion 2). Accordingly, the strength of the upper substrate 5 may be enhanced. Besides, when a concentrated load is applied to the front surface of the upper substrate 5, tensile stresses applied to the front surface of the upper substrate 5 may be dispersed. As a result, the thermal head 1 may be provided as the reliable one being less likely to crack even if a minute foreign matter of several to tens of μm is trapped between the platen roller 13 and the thermal paper 12 to apply a concentrated load to the upper substrate 5, or in other similar cases.

Here, a material used for the protective film 9 of the thermal head 1 has a significantly large internal stress. For example, a SiAlON film formed by sputtering has an internal stress of 500 to 2,000 MPa. Accordingly, directly above the cavity portion 4 (concave portion 2), the convex portion 20 is provided in the front surface of the upper substrate 5 to increase the plate thickness of the upper substrate 5 so that the strength of the upper substrate 5 is enhanced to prevent the upper substrate 5 from being deformed or broken due to the internal stress of the protective film 9.

Further, in the thermal head 1 according to this embodiment, the electrode 8 including the thin portion 18 is disposed outside the convex portion 20. This prevents the thin portion 18 of the electrode 8 from crossing over the step of the convex portion 20, and further prevents the thin portion 18 from being applied with pressure from the platen roller. Therefore, the reliability of the thermal head may be improved.

Further, the convex portion 20 has the distal end surface 21 that is substantially parallel to the front surface of the upper substrate 5, and hence a load of the platen roller 13 may be imposed over the distal end surface 21 of the convex portion 20, to thereby prevent a concentrated load from being imposed on a part of the convex portion 20.

Therefore, according to the thermal printer 10 including the above-mentioned thermal head 1, while ensuring the strength of the upper substrate 5, the thermal efficiency of the thermal head 1 may be increased to reduce the amount of energy required for printing. As a result, printing on the thermal paper 12 may be performed with low power to prolong battery duration. Besides, a failure due to the breakage of the upper substrate 5 may be prevented to enhance device reliability.

First Modified Example

A first modified example of the thermal head 1 according to this embodiment is described below. Note that, the description common to the above-mentioned thermal head 1 according to the first embodiment is omitted below, and hence the following description is mainly directed to differences.

Figure 5:
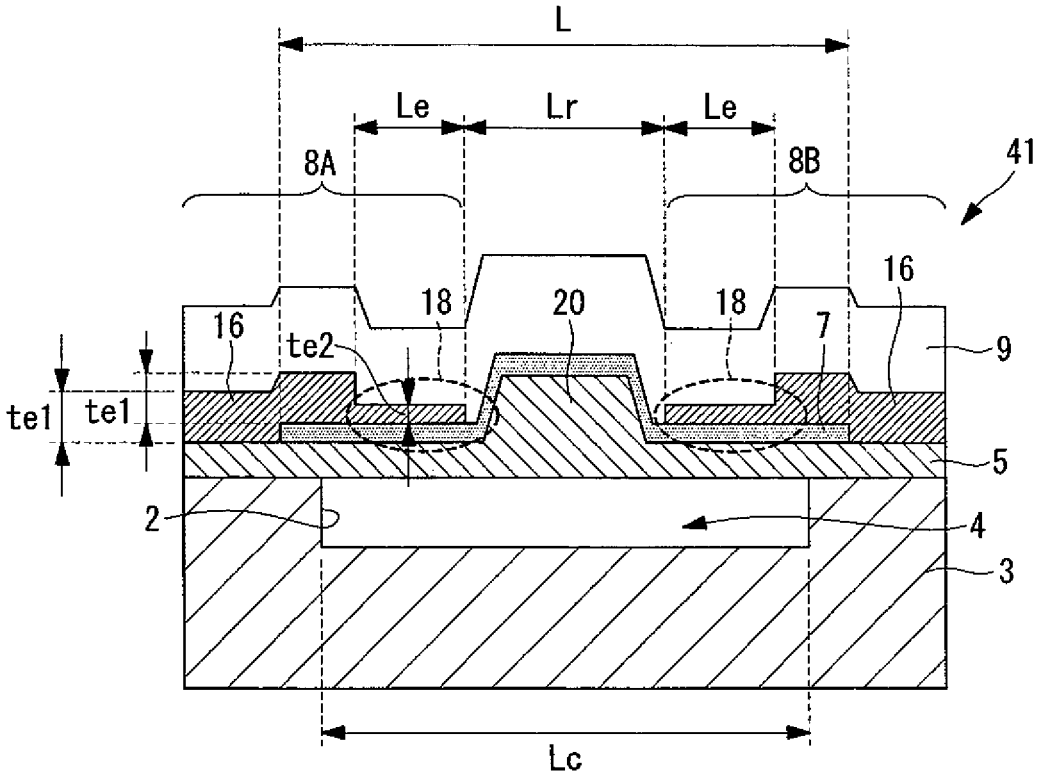
FIG. 5 is a cross-sectional view of a thermal head according to a first modified example of FIG. 3.

In the thermal head 1 according to the first embodiment, as illustrated in FIG. 3, the thin portion 18 of the electrode 8 is disposed in the range of from the inside of the region on the heating resistor 7 corresponding to the concave portion 2 to the outside of the region. In contrast, in a thermal head 41 according to this modified example, as illustrated in FIG. 5, the thin portion 18 of the electrode 8 is formed inside the region on the heating resistor 7 corresponding to the concave portion 2. In other words, in the thermal head 41 according to this modified example, the thick portion 16 is also formed inside the region on the heating resistor 7 corresponding to the concave portion 2.

With such a structure, the heat dissipation amount via the thick portion 16 of the electrode 8 is increased, but the electrical resistance value of the electrode 8 may be reduced to improve the heating efficiency of the heating resistor 7.

Second Modified Example

A second modified example of the thermal head 1 according to this embodiment is described below.

Figure 6:
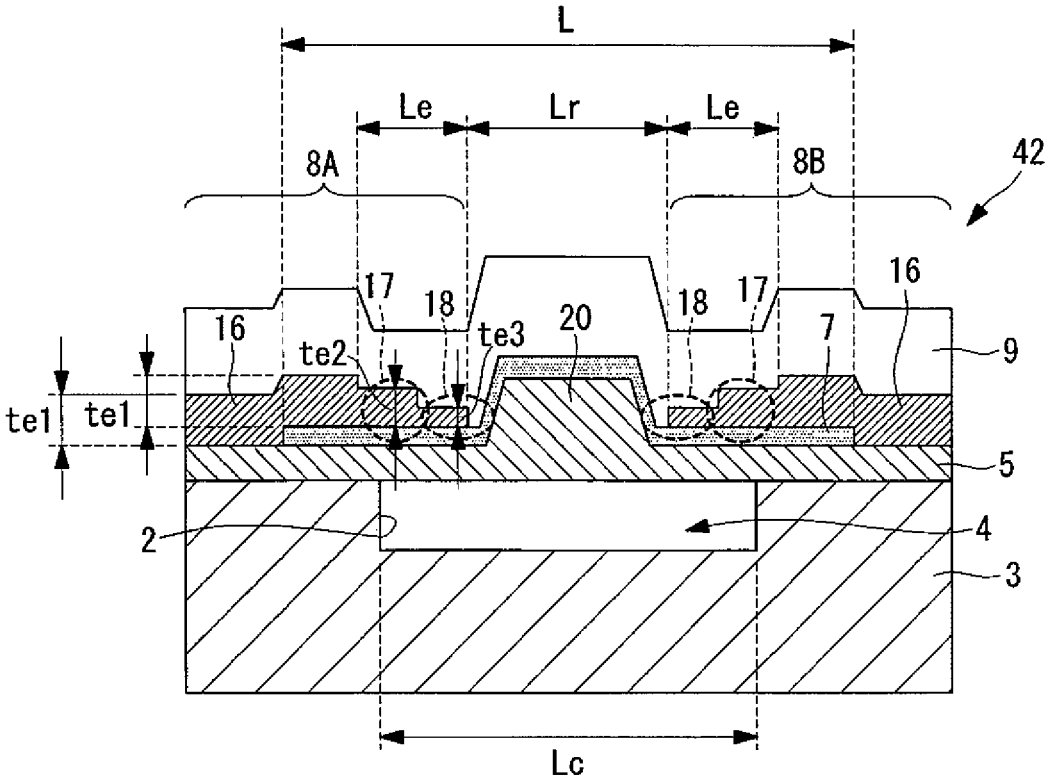
FIG. 6 is a cross-sectional view of a thermal head according to a second modified example of FIG. 3.

In the thermal head 1 according to the first embodiment, as illustrated in FIG. 3, the electrode 8 is formed of a two-stage structure including the thin portion 18 and the thick portion 16. In contrast, in a thermal head 42 according to this modified example, as illustrated in FIG. 6, the electrode 8 in the vicinity of the heating resistor 7 is formed of a three-stage structure including the thin portion 18, an intermediate portion 17, and the thick portion 16.

With such a structure, the thermal efficiency of the entire thermal head may be optimized considering a balance between the heat dissipation amount via the thick portion 16 of the electrode 8 and the electrical resistance value of the electrode 8 (heating efficiency of the heating resistor 7). Further, the intermediate portion 17 is provided, and hence the step of the electrode 8 may be reduced to improve the formation state of the protective film 9 with respect to the electrode 8, to thereby prevent the peeling between the electrode 8 and the protective film 9.

Note that, in this modified example, the electrode 8 is formed of a three-stage structure, but may be formed of four or more stages.

Third Modified Example

A third modified example of the thermal head 1 according to this embodiment is described below.

Figure 7:
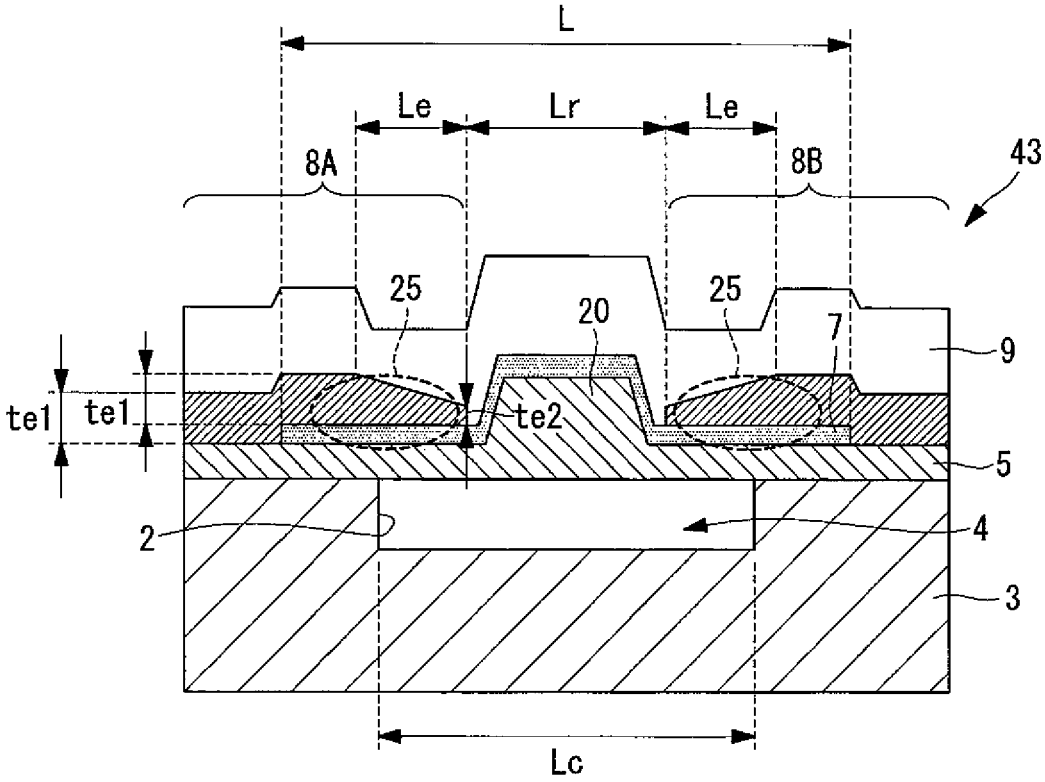
FIG. 7 is a plan view of a thermal head according to a third modified example of FIG. 3 viewed from a protective film side.

In the thermal head 1 according to the first embodiment, as described above, the electrode 8 is formed of a two-stage structure including the thin portion 18 and the thick portion 16. In contrast, in a thermal head 43 according to this modified example, as illustrated in FIG. 7, the electrode 8 in the vicinity of the heating resistor 7 includes a tapered portion 25 which is formed so as to be thicker from the inside to the outside.

With such a structure, similarly to the thermal head 1 according to the first embodiment, the amount of heat that diffuses from the region corresponding to the concave portion 2 (cavity portion 4) toward the outside via the electrode 8 may be reduced, and the electrical resistance value of the electrode 8 may be reduced to improve the heating efficiency of the heating resistor 7. Further, the formation state of the protective film 9 with respect to the electrode 8 may be improved to prevent the peeling between the electrode 8 and the protective film 9.

Second Embodiment

Now, as a second embodiment of the present invention, a method of manufacturing the above-mentioned thermal head 1 according to the first embodiment is described below.

As illustrated in FIGS. 8A to 8H, the method of manufacturing the thermal head 1 according to this embodiment includes an opening portion forming step of forming an opening portion (concave portion 2) in the front surface of the support substrate 3, a bonding step of bonding the rear surface of the upper substrate 5 in a stacked state to the front surface of the support substrate 3 having the concave portion 2 formed therein, a thinning step of thinning the upper substrate 5 bonded to the support substrate 3, a convex portion forming step of forming the convex portion 20 in the front surface of the upper substrate 5 bonded to the support substrate 3, a resistor forming step of forming the heating resistors 7 on the front surface of the upper substrate 5 in a region corresponding to the cavity portion 4, an electrode layer forming step of forming the electrodes 8 at both ends of the heating resistors 7, and a protective film forming step of forming the protective film 9 over the electrodes 8. Hereinafter, the above-mentioned steps are specifically described.

Figure 8A:
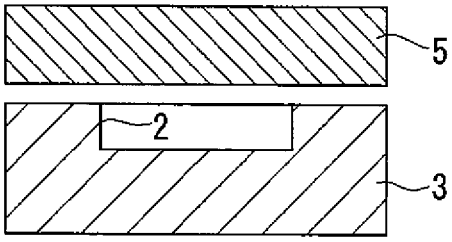

In the opening portion forming step, as illustrated in FIG. 8A, in the upper end surface (front surface) of the support substrate 3, the concave portion 2 is formed at a position corresponding to a region of the upper substrate 5, in which the heating resistors 7 are to be provided. The concave portion 2 is formed in the front surface of the support substrate 3 by performing, for example, sandblasting, dry etching, wet etching, or laser machining.

In the case where sandblasting is performed on the support substrate 3, the front surface of the support substrate 3 is covered with a photoresist material, and the photoresist material is exposed to light using a photomask of a predetermined pattern so as to be cured in part other than the region for forming the concave portion 2. After that, the front surface of the support substrate 3 is cleaned and the uncured photoresist material is removed to obtain etching masks (not shown) having etching windows formed in the region for forming the concave portion 2. In this state, sandblasting is performed on the front surface of the support substrate 3 to form the concave portion 2 at a depth ranging from 1 μm to 100 μm. It is preferred that the depth of the concave portion 2 be, for example, 10 μm or more and half or less of the thickness of the support substrate 3.

In the case where etching such as dry etching and wet etching is performed, as in the case of sandblasting, the etching masks having the etching windows formed in the region for forming the concave portion 2 are formed on the front surface of the support substrate 3. In this state, etching is performed on the front surface of the support substrate 3 to form the concave portion 2 at a depth ranging from 1 μm to 100 μm.

As such an etching process, for example, wet etching using hydrofluoric acid-based etchant or the like is available as well as dry etching such as reactive ion etching (RIE) and plasma etching. Note that, as a reference example, in a case of a single-crystal silicon support substrate, wet etching is performed using an etchant such as a tetramethylammonium hydroxide solution, a KOH solution, or a mixed solution of hydrofluoric acid and nitric acid.

Figure 8B:
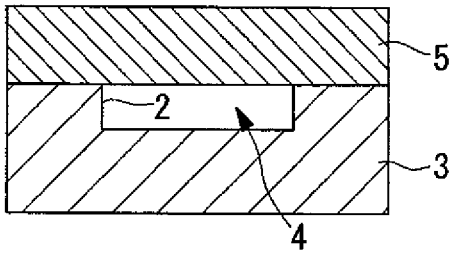

Next, in the bonding step, as illustrated in FIG. 8B, the lower end surface (rear surface) of the upper substrate 5, which is a glass substrate or the like having a thickness approximately ranging from 500 μm to 700 μm, for example, and the upper end surface (front surface) of the support substrate 3 having the concave portion 2 formed therein are bonded to each other by high temperature fusing or anodic bonding. At this time, the support substrate 3 and the upper substrate 5 are bonded to each other in a dry state, and the substrates thus bonded to each other are subjected to heat treatment at a temperature equal to or higher than 200° C. and equal to or lower than softening points thereof, for example.

After the support substrate 3 and the upper substrate 5 are bonded to each other, the concave portion 2 formed in the support substrate 3 is covered with the upper substrate 5 to form the cavity portion 4 between the support substrate 3 and the upper substrate 5.

Here, it is difficult to manufacture and handle an upper substrate having a thickness of 100 μm or less, and such a substrate is expensive. Thus, instead of directly bonding an originally thin upper substrate 5 onto the support substrate 3, the upper substrate 5 thick enough to be easily manufactured and handled in the bonding step is bonded onto the support substrate 3, and then the upper substrate 5 is processed in the thinning step so as to have a desired thickness.

Figure 8C:
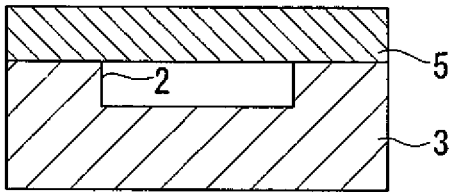

Next, in the thinning step, as illustrated in FIG. 8C, mechanical polishing is performed on the upper end surface (front surface) of the upper substrate 5 to process the upper substrate 5 to be thinned to, for example, about 1 to 100 μm. Note that, the thinning process may be performed by dry etching, wet etching, or the like.

Figure 8D:
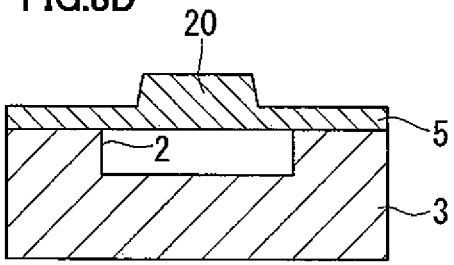

Next, in the convex portion forming step, as illustrated in FIG. 8D, dry etching, wet etching, or the like is performed to form the convex portion 20 in the upper end surface (front surface) of the upper substrate 5 in the region corresponding to the concave portion 2 formed in the support substrate 3. Note that, the convex portion forming step may be performed simultaneously with the thinning step. In other words, in the above-mentioned thinning step, with the region for forming the convex portion 20 covered with a resist material, dry etching, wet etching, or the like may be performed to form the convex portion 20 simultaneously with the thinning of the upper substrate 5.

Next, the heating resistors 7, the common electrode 8A, the individual electrodes 8B, and the protective film 9 are successively formed on the upper substrate 5.

Figure 8E:
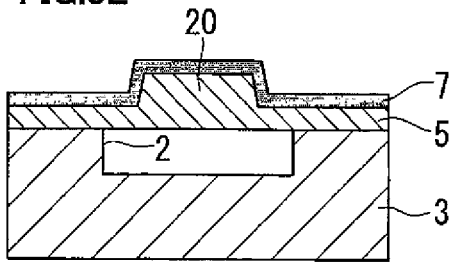

Specifically, in the resistor forming step, as illustrated in FIG. 8E, a thin film forming method such as sputtering, chemical vapor deposition (CVD), or vapor deposition is used to form a thin film of a heating resistor material on the upper substrate 5, such as a Ta-based thin film or a silicide-based thin film. The thin film of the heating resistor material is molded by lift-off, etching, or the like to form the heating resistors 7 having a desired shape.

Next, the electrode layer forming step is performed. The electrode layer forming step includes a first layer forming step of forming an underlayer (hereinafter, referred to as first layer 16*a*) of the thick portion 16 of the electrode 8 as illustrated in FIG. 8F, and a second layer forming step of forming a second layer 16*b* on the first layer 16*a* as illustrated in FIG. 8G.

Figure 8F:
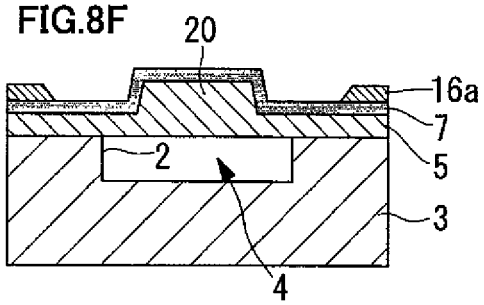

In the first layer forming step, as illustrated in FIG. 8F, the first layers 16*a* are formed at both end portions of the heating resistor 7 on the outer side of the region corresponding to the cavity portion 4. The first layer 16*a* is formed in a manner that a film of a wiring material such as Al, Al—Si, Au, Ag, Cu, or Pt is deposited by sputtering, vapor deposition, or the like. Then, the film thus obtained is formed by lift-off or etching, or alternatively the wiring material is baked after screen-printing, to thereby form the first layer 16*a* having a desired shape. The thickness of the first layer 16*a* is, for example, approximately 1 μm to 3 μm in consideration of a power loss in the wiring of the electrode 8.

Figure 8G:
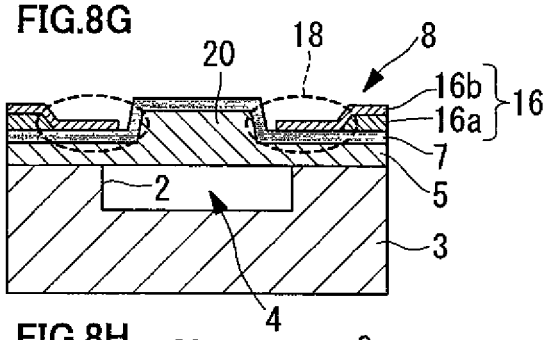
Figure 8H:
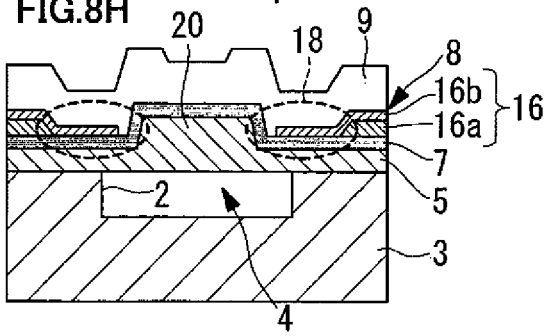

Subsequently, in the second layer forming step, as illustrated in FIG. 8G, the second layers 16*b* are formed in a range of from the inside of a region at both end portions of the heating resistor 7 corresponding to the cavity portion 4 to the outside of the region at a substantially uniform thickness. The second layer 16*b* is formed in a manner that a film of the same material as that of the first layer 16*a* is deposited by sputtering, vapor deposition, or the like. Then, the film thus obtained is formed by lift-off or etching, or alternatively the wiring material is baked after screen-printing, to thereby form the second layer 16*b* having a desired pattern.

The second layer 16*b* having a uniform thickness is formed on each of the surface of the first layer 16*a* and the surface of the heating resistor 7, and hence the electrode 8 having a two-stage structure including the thin portion 18 formed of the second layer 16*b* and the thick portion 16, which is thicker than the thin portion 18 by the first layer 16*a*, may be formed.

It is desired to set the thickness of the thin portion 18 (second layer 16*b*) formed as described above to, for example, approximately 50 nm to approximately 300 nm in consideration of the thickness and the thermal conductivity of the thick portion 16 (the thermal conductivity of Al is approximately 200 W/(m·° C.)) and the thickness and the thermal conductivity of the upper substrate 5 (the thermal conductivity of commonly-used glass is approximately 1 W/(m·° C.)).

Next, in the protective film forming step, as illustrated in FIG. 8G, a film of a protective film material such as $SiO_2$, $Ta_2O_5$, SiAlON, $Si_3N_4$, or diamond-like carbon is deposited on the upper substrate 5 by sputtering, ion plating, CVD, or the like to form the protective film 9. This way, the thermal head 1 illustrated in FIG. 3 is manufactured.

According to the method of manufacturing the thermal head 1, the thermal head 1 may be manufactured, in which the cavity portion 4 is formed between the support substrate 3 and the upper substrate 5, and the convex portion 20 is formed between the electrode layers formed at both ends of the heating resistors 7. Further, at both the ends of the heating resistor, the electrode layers each including the thin portion 18 which is connected to the heating resistor 7 in the region corresponding to the concave portion 2 and the thick portion 16 which is connected to the heating resistor 7 and is formed thicker than the thin portion 18 may be formed. This way, as described above, while ensuring the strength of the upper substrate 5, the thermal efficiency of the thermal head 1 may be increased to reduce the amount of energy required for printing.

Modified Example

A modified example of the method of manufacturing the thermal head 1 according to this embodiment is described below.

The method of manufacturing the thermal head 1 according to this modified example is different from the method of manufacturing the thermal head 1 according to the above-mentioned second embodiment in a method involving forming the thin portion 18 and the thick portion 16 of the electrode 8. Hereinafter, the description common to the method of manufacturing the thermal head 1 according to the second embodiment is omitted, and the following description is mainly directed to the difference.

In the method of manufacturing the thermal head 1 according to the above-mentioned second embodiment, the electrode 8 is formed so as to have a two-stage structure through the first layer forming step and the second layer forming step. On the other hand, in the method of manufacturing the thermal head 1 according to this modified example, the electrode 8 is formed so as to have a two-stage structure by etching.

Figure 9A:
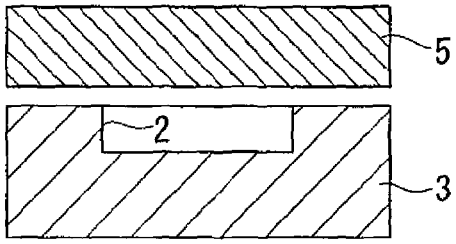
Figure 9B:
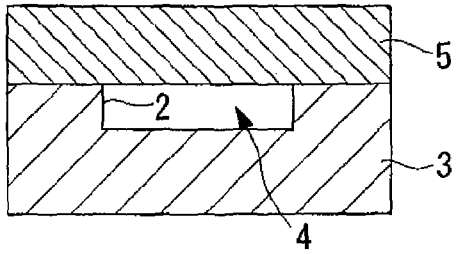
Figure 9C:
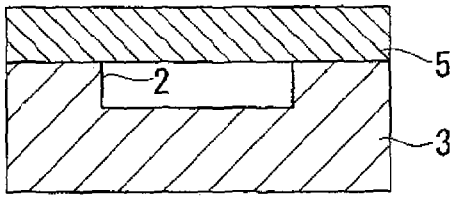
Figure 9D:
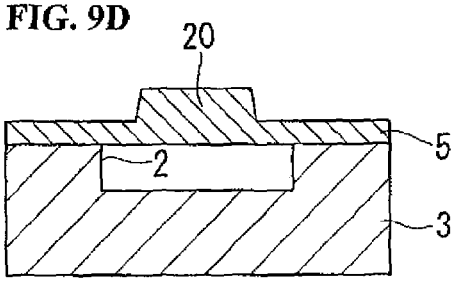
Figure 9E:
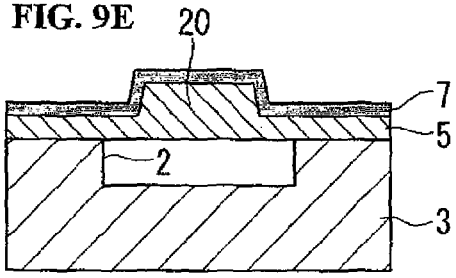
Figure 9F:
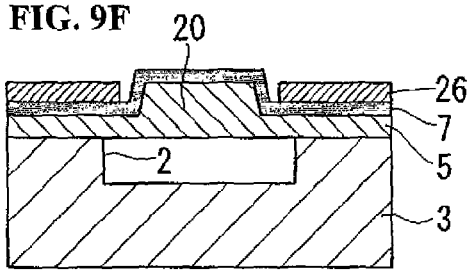
Figure 9G:
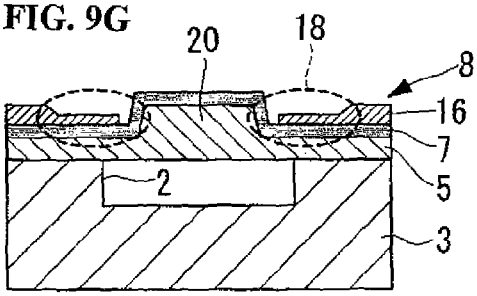
Figure 9H:
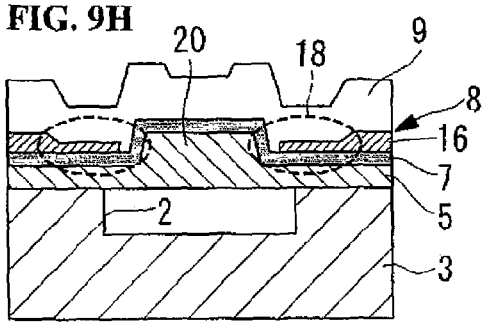

Specifically, in the method of manufacturing the thermal head 1 according to this modified example, the electrode layer forming step includes a thick electrode layer forming step of forming a thick electrode layer 26 at a thickness equal to or larger than that of the thick portion 16 as illustrated in FIG. 9F, and an electrode layer removing step of removing a part of the thick electrode layer 26 as illustrated in FIG. 9G.

In the thick electrode layer forming step, as illustrated in FIG. 9F, the thick electrode layers 26 are formed in a range of from the inside of a region at both end portions of the heating resistor 7 corresponding to the cavity portion 4 to the outside of the region at a substantially uniform thickness which is equal to or larger than the that of the thick portion 16. The thick electrode layer 26 is formed in a manner that a film of a wiring material such as Al, Al—Si, Au, Ag, Cu, or Pt is deposited by sputtering, vapor deposition, or the like. Then, the film thus obtained is formed by lift-off or etching, or alternatively the wiring material is baked after screen-printing, to thereby form a pattern of the electrode 8 having a desired shape.

In the electrode layer removing step, as illustrated in FIG. 9G, the inside of a region of the thick electrode layer 26 corresponding to the cavity portion 4 and a part of the outside of the region (i.e., a region in which the thin portion 18 is to be formed) are removed by etching. With this, the electrode 8 having a two-stage structure including the thick portion 16 and the thin portion 18, which is thinner than the thick portion 16 by the amount removed by etching, may be formed.

As described above, according to the method of manufacturing the thermal head 1 of this modified example, in addition to the same effect as in the method of manufacturing the thermal head 1 according to the above-mentioned second embodiment, an interface between the first layer 16*a* and the second layer 16*b* of the electrode 8 may be eliminated to improve the strength and the electrical conductivity of the electrode 8.

Hereinabove, the embodiments of the present invention have been described in detail with reference to the accompanying drawings. However, specific structures of the present invention are not limited to those embodiments, and include design modifications and the like without departing from the gist of the present invention.

For example, the present invention is not particularly limited to one of the above-mentioned embodiments and modified examples, and may be applied to an embodiment in an appropriate combination of the embodiments and modified examples.

Further, although the description has been given of the convex portion 20 having a trapezoidal shape in longitudinal cross-section, the convex portion 20 may be formed into any other shape in longitudinal cross-section, such as a rectangular shape or curved shape, as long as the heating resistors 7 may be formed.

Further, the rectangular concave portion 2 extending in the longitudinal direction of the support substrate 3 is formed, and the cavity portion 4 has the communication structure opposed to all the heating resistors 7, but as an alternative thereto, concave portions 2 independent of one another may be formed in the longitudinal direction of the support substrate 3 at positions opposed to the heating resistors 7, and cavity portions 4 independent for each concave portion 2 may be formed through closing the respective concave portions 2 by the upper substrate 5. In this manner, a thermal head including a plurality of hollow heat-insulating layers independent of one another may be formed.

Further, although the description has been given of the thick portion 16 and the thin portion 18 which are provided to both of the pair of electrodes 8, the thick portion 16 and the thin portion 18 may be provided to only one of the pair of electrodes 8.

What is claimed is:

1. A thermal head, comprising:

a support substrate including a concave portion formed in a front surface thereof;

an upper substrate bonded in a stacked state to the front surface of the support substrate, the upper substrate including a convex portion formed at a position corresponding to the concave portion;

a heating resistor provided on a front surface of the upper substrate at a position straddling the convex portion; and a pair of electrodes provided on both sides of the heating resistor, each of the electrodes being formed in a region outside of the convex portion, and the convex portion extending at a height greater than each of the electrodes;

wherein at least one of the pair of electrodes comprises:

a thin portion connected to the heating resistor in a region corresponding to the concave portion; and a thick portion connected to the heating resistor and having a thickness greater than that of the thin portion.

2. A thermal head according to claim 1, wherein the convex portion is formed within a region corresponding to the concave portion.

3. A thermal head according to claim 1, wherein the convex portion comprises:

a flat distal end surface; and side surfaces extending and inclining from both ends of the distal end surface so that the convex portion is gradually narrower toward the distal end surface.

4. A thermal head comprising:

a support substrate including a concave portion formed in a front surface thereof;

an upper substrate bonded in a stacked state to the front surface of the support substrate, the upper substrate including a convex portion formed at a position corresponding to the concave portion;

a heating resistor provided on a front surface of the upper substrate at a position straddling the convex portion; and a pair of electrodes provided on both sides of the heating resistor and in a region outside of the convex portion;

wherein at least one of the pair of electrodes comprises:

a thin portion connected to the heating resistor and extending to an outside of the region corresponding to the concave portion; and a thick portion connected to the heating resistor and having a thickness greater than that of the thin portion.

5. A thermal head according to claim 1, wherein both of the pair of electrodes comprise the thin portion.

6. A printer, comprising:

the thermal head according to claim 1; and a pressure mechanism for feeding a thermal recording medium while pressing the thermal recording medium against the heating resistor of the thermal head.

7. A method of manufacturing a thermal head, comprising:

forming an opening portion in a front surface of a support substrate;

bonding a rear surface of an upper substrate in a stacked state to the front surface of the support substrate on which the opening portion has been formed;

thinning the upper substrate which has been bonded to the front surface of the support substrate;

forming a convex portion in a front surface of the upper substrate which has been bonded to the front surface of the support substrate;

forming a heating resistor on the front surface of the upper substrate in a region corresponding to the opening portion; and forming electrode layers in a region outside of the convex portion and at both ends of the heating resistor which has been formed on the front surface of the upper substrate so that each of the electrode layers has a thin portion connected to the heating resistor in a region corresponding to the opening portion and has a thick portion connected to the heating resistor, the thick portion having a thickness greater than that of the thin portion, and the convex portion being formed so as to extend at a height greater than each of the electrode layers.

8. A method according to claim 7, wherein the convex portion is formed within a region corresponding to the opening portion formed in the front surface of the support substrate.

9. A method according to claim 7, wherein the convex portion is formed with a flat distal end surface and side surfaces extending and inclining from both ends of the distal end surface so that the convex portion is gradually narrower toward the distal end surface.

10. A method according to claim 7, wherein the electrode layers are formed so that the thin portion of each electrode layer extends to an outside of the region corresponding to the concave portion.

11. A thermal head comprising:

a first substrate having a concave portion formed in a surface thereof;

a second substrate bonded to surface of the first substrate, the second substrate having a convex portion formed at a position corresponding to the concave portion of the first substrate a heating resistor disposed on a surface of the second substrate at a position straddling the convex portion; and a pair of electrodes each formed in a region outside of the convex portion, at least one of the pair of electrodes having a first portion connected to the heating resistor in a region corresponding to the concave portion and having a second portion connected to the heating resistor, the second portion having a thickness greater than that of the first portion, and the convex portion extending at a height greater than each of the electrodes.

12. A thermal head according to claim 11, wherein the convex portion is formed within a region corresponding to the concave portion.

13. A thermal head according to claim 11, wherein the convex portion comprises a flat distal end surface, and side surfaces extending and inclining from both ends of the distal end surface so that the convex portion is gradually narrower toward the distal end surface.

14. A thermal head according to claim 11, wherein the first portion of the at least one of the pair of electrodes extends to an outside of the region corresponding to the concave portion.

15. A thermal head according to claim 11, wherein each one of the electrodes comprises the first portion.

16. A printer comprising: the thermal head according to claim 11; and a pressure mechanism for feeding a thermal recording medium while pressing the thermal recording medium against the heating resistor of the thermal head.

17. A thermal head comprising:

a support substrate including a concave portion formed in a front surface thereof;

an upper substrate bonded in a stacked state to the front surface of the support substrate, the upper substrate including a convex portion formed within a region corresponding to the concave portion;

a heating resistor provided on a front surface of the upper substrate at a position straddling the convex portion; and a pair of electrodes provided on both sides of the heating resistor and formed in a region outside the convex portion;

wherein at least one of the pair of electrodes comprises a thin portion connected to the heating resistor and extending to an outside of the region corresponding to the concave portion, and a thick portion connected to the heating resistor and having a thickness greater than that of the thin portion; and wherein the convex portion comprises a flat distal end surface and side surfaces formed extending and inclining from both ends of the distal end surface so that the convex portion is gradually narrower toward the distal end surface.

* * * * *